US011808283B2

(12) United States Patent
Lombard et al.

(10) Patent No.: US 11,808,283 B2
(45) Date of Patent: Nov. 7, 2023

(54) TURBOCHARGER HAVING ADJUSTABLE-TRIM CENTRIFUGAL COMPRESSOR INCLUDING AIR INLET WALL HAVING CAVITIES FOR SUPPRESSION OF NOISE AND FLOW FLUCTUATIONS

(71) Applicant: Garrett Transportation I Inc., Torrance, CA (US)

(72) Inventors: Alain Lombard, Vosges (FR); Hani Mohtar, Lorraine (FR); Dominique Colombier, Vosges (FR); Stephane Pees, Ceintrey Meurthe-et-Moselle (FR)

(73) Assignee: Garrett Transportation I Inc., Torrance, CA (US)

( * ) Notice: Subject to any disclaimer, the term of this patent is extended or adjusted under 35 U.S.C. 154(b) by 52 days.

(21) Appl. No.: 17/445,734

(22) Filed: Aug. 24, 2021

(65) Prior Publication Data

US 2021/0381528 A1 Dec. 9, 2021

Related U.S. Application Data

(62) Division of application No. 16/395,651, filed on Apr. 26, 2019, now abandoned.

(51) Int. Cl.

| | |
|---|---|
| ***F04D 29/66*** | (2006.01) |
| ***F01D 9/04*** | (2006.01) |
| ***F01D 17/10*** | (2006.01) |
| ***F02B 33/40*** | (2006.01) |

(52) U.S. Cl.
CPC ..... *F04D 29/665* (2013.01); *F01D 9/04* (2013.01); *F01D 17/10* (2013.01); *F02B 33/40* (2013.01)

(58) Field of Classification Search
CPC ..... F04D 29/665; F01D 9/04; F01D 17/10; F02B 33/40
See application file for complete search history.

(56) References Cited

U.S. PATENT DOCUMENTS

| | | | | |
|---|---|---|---|---|
| 10,544,808 | B2 * | 1/2020 | Mohtar | F16K 3/03 |
| 10,550,761 | B2 * | 2/2020 | Lombard | F04D 29/4206 |
| 10,570,905 | B2 * | 2/2020 | Mohtar | F04D 29/685 |
| 10,619,561 | B2 * | 4/2020 | Lombard | F04D 29/464 |
| 2017/0298953 | A1 * | 10/2017 | Lombard | F04D 29/464 |

FOREIGN PATENT DOCUMENTS

WO WO-2020153963 A1 * 7/2020

* cited by examiner

*Primary Examiner* — Loren C Edwards
(74) *Attorney, Agent, or Firm* — Christian Reinders

(57) ABSTRACT

A compressor for a turbocharger includes an inlet-adjustment mechanism in an air inlet for the compressor, operable to move between an open position and a closed position in the air inlet. The compressor housing upstream of the inlet-adjustment mechanism defines a series of acoustic cavities, and openings are defined in the compressor housing wall leading into the acoustic cavities. The openings and cavities are aimed at mitigating noise and flow pulsation in the air inlet caused when the inlet-adjustment mechanism is adjusted to the closed position to effectively reduce the inlet diameter approaching the compressor wheel.

3 Claims, 7 Drawing Sheets

TURBOCHARGER HAVING ADJUSTABLE-TRIM CENTRIFUGAL COMPRESSOR INCLUDING AIR INLET WALL HAVING CAVITIES FOR SUPPRESSION OF NOISE AND FLOW FLUCTUATIONS

BACKGROUND OF THE INVENTION

The present disclosure relates to centrifugal compressors, such as used in turbochargers, and more particularly relates to centrifugal compressors in which the effective inlet area or diameter can be adjusted for different operating conditions by means of an inlet-adjustment mechanism disposed in the air inlet for the compressor.

An exhaust gas-driven turbocharger is a device used in conjunction with an internal combustion engine for increasing the power output of the engine by compressing the air that is delivered to the air intake of the engine to be mixed with fuel and burned in the engine. A turbocharger comprises a compressor wheel mounted on one end of a shaft in a compressor housing and a turbine wheel mounted on the other end of the shaft in a turbine housing. Typically the turbine housing is formed separately from the compressor housing, and there is yet another center housing connected between the turbine and compressor housings for containing bearings for the shaft. The turbine housing defines a generally annular chamber that surrounds the turbine wheel and that receives exhaust gas from an engine. The turbine assembly includes a nozzle that leads from the chamber into the turbine wheel. The exhaust gas flows from the chamber through the nozzle to the turbine wheel and the turbine wheel is driven by the exhaust gas. The turbine thus extracts power from the exhaust gas and drives the compressor. The compressor receives ambient air through an inlet of the compressor housing and the air is compressed by the compressor wheel and is then discharged from the housing to the engine air intake.

Turbochargers typically employ a compressor wheel of the centrifugal (also known as "radial") type because centrifugal compressors can achieve relatively high pressure ratios in a compact arrangement. Intake air for the compressor is received in a generally axial direction at an inducer portion of the centrifugal compressor wheel and is discharged in a generally radial direction at an exducer portion of the wheel. The compressed air from the wheel passes through a diffuser before being delivered to a volute, and from the volute the air is supplied to the intake of an internal combustion engine.

The operating range of the compressor is an important aspect of the overall performance of the turbocharger. The operating range is generally delimited by a surge line and a choke line on an operating map for the compressor. The compressor map is typically presented as pressure ratio (discharge pressure Pout divided by inlet pressure Pin) on the vertical axis, versus corrected mass flow rate on the horizontal axis. The choke line on the compressor map is located at high flow rates and represents the locus of maximum mass-flow-rate points over a range of pressure ratios; that is, for a given point on the choke line, it is not possible to increase the flow rate while maintaining the same pressure ratio because a choked-flow condition occurs in the compressor.

The surge line is located at low flow rates and represents the locus of minimum mass-flow-rate points without surge, over a range of pressure ratios; that is, for a given point on the surge line, reducing the flow rate without changing the pressure ratio, or increasing the pressure ratio without changing the flow rate, would lead to surge occurring. Surge is a flow instability that typically occurs when the compressor blade incidence angles become so large that substantial flow separation arises on the compressor blades. Pressure fluctuation and flow reversal can happen during surge.

In a turbocharger for an internal combustion engine, compressor surge may occur when the engine is operating at high load or torque and low engine speed, or when the engine is operating at a low speed and there is a high level of exhaust gas recirculation (EGR). Surge can also arise when an engine is suddenly decelerated from a high-speed condition. Expanding the surge-free operation range of a compressor to lower flow rates is a goal often sought in compressor design.

Applicant is the owner of several patent applications (hereinafter, "the commonly owned applications") describing various inlet-adjustment mechanisms for delaying the onset of surge to lower flow rates at a given compressor pressure ratio (i.e., shifting the surge line to the left on the compressor map), including but not limited to: application Ser. No. 14/642,825 filed on Mar. 10, 2015; Ser. No. 14/551,218 filed on Nov. 24, 2014; Ser. No. 14/615,428 filed on Feb. 6, 2016; Ser. No. 15/446,054 filed on Mar. 1, 2017; Ser. No. 15/446,090 filed on Mar. 1, 2017; Ser. No. 15/456,403 filed on Mar. 10, 2017; Ser. No. 15/836,781 filed on Dec. 8, 2017; Ser. No. 15/806,267 filed on Nov. 7, 2017; Ser. No. 15/822,093 filed on Nov. 24, 2017; Ser. No. 15/907,420 filed on Feb. 28, 2018; Ser. No. 15/904,493 filed on Feb. 26, 2018; and Ser. No. 15/909,899 filed on Mar. 1, 2018; the entire disclosures of all of said applications being hereby incorporated herein by reference. Inlet-adjustment mechanisms in accordance with said applications generally include a plurality of blades or vanes that collectively circumscribe an orifice whose effective diameter is adjustable by movement of the blades or vanes radially inwardly or outwardly. By adjusting the effective compressor inlet diameter to a reduced value at operating conditions where surge may be imminent, the surge line on the compressor map is shifted toward lower flow rates, thereby preventing surge from occurring at said operating conditions.

The present application is concerned with improvements to turbochargers having an inlet-adjustment mechanism generally of the type described above.

BRIEF SUMMARY OF THE DISCLOSURE

The present disclosure is directed to turbochargers having a compressor and an inlet-adjustment mechanism for the compressor that can enable the surge line for the compressor to selectively be shifted to the left (i.e., surge is delayed to a lower flow rate at a given pressure ratio). It has been found that when the inlet-adjustment mechanism is closed, noise and flow pulsation can occur in the air inlet of the compressor. The present disclosure describes embodiments of turbochargers that can at least partially mitigate such noise and flow pulsation. Described herein are turbochargers having the following features:

- a turbine including a turbine housing;
- a compressor assembly comprising a compressor housing and a compressor wheel mounted in the compressor housing and connected to a rotatable shaft for rotation therewith, the compressor wheel having blades and defining an inducer portion, the compressor housing comprising a first housing portion and a second housing portion, the first housing portion including an air inlet wall circumscribing an air inlet for the compressor wheel, the second housing portion defining a tip shroud for the compressor wheel and defining a volute for receiving compressed air from the compressor wheel, the compressor housing upstream of the compressor wheel defining an annular space located radially outward of the air inlet, an axial extent of the annular space being bounded between a radially extending upstream wall which is part of the first housing portion and a radially extending downstream wall which is part of the second housing portion, a radially innermost extremity of the annular space being open to the air inlet;

an inlet-adjustment mechanism disposed in the annular space and adjustable between an open position and a closed position, the inlet-adjustment mechanism being movable radially inwardly from the annular space into the air inlet into the closed position so as to create an orifice having a reduced diameter relative to a nominal diameter of the air inlet; and wherein the first housing portion defines a first opening that leads into a first quarter-wave resonator cavity defined within the first housing portion, the first opening being defined in the radially extending upstream wall.

In another embodiment, a plurality of openings are defined in the radially extending upstream wall of the first housing portion, and a plurality of quarter-wave resonator cavities are defined within the first housing portion, one opening for each cavity. The openings are circumferentially spaced apart about the annular space that houses the inlet-adjustment mechanism.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present inventions now will be described more fully hereinafter with reference to the accompanying drawings, in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
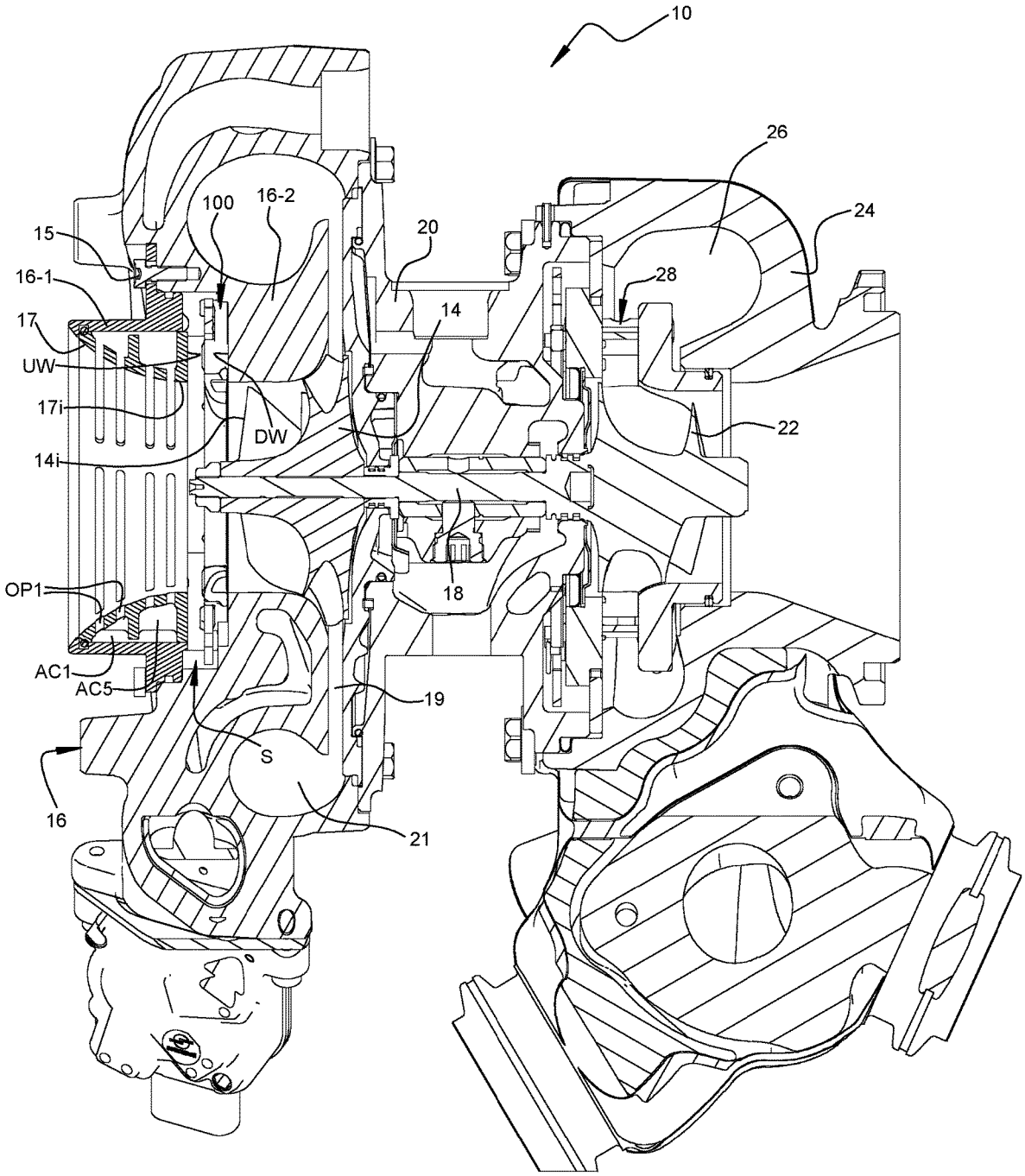
FIG. 1 is an axial cross-sectional view of a turbocharger in accordance with a first embodiment of the invention.

A turbocharger 10 in accordance with one embodiment of the invention is illustrated in axial cross-sectional view in FIG. 1. The turbocharger includes a compressor and a turbine. The compressor comprises a compressor wheel or impeller 14 mounted in a compressor housing 16 on one end of a rotatable shaft 18. The compressor housing includes a wall that defines an air inlet 17 for leading air generally axially into the compressor wheel 14. The shaft is supported in bearings mounted in a center housing 20 of the turbocharger. The shaft is rotated by a turbine wheel 22 mounted on the other end of the shaft from the compressor wheel, thereby rotatably driving the compressor wheel, which compresses air drawn in through the compressor inlet and discharges the compressed air generally radially outwardly from the compressor wheel. The compressed air passes through a diffuser 19 before entering into a volute 21 for collecting the compressed air. From the volute 21, the air is routed to the intake of an internal combustion engine (not shown) for boosting the performance of the engine.

The turbine wheel 22 is disposed within a turbine housing 24 that defines an annular chamber 26 for receiving exhaust gases from an internal combustion engine (not shown). The turbine housing also defines a nozzle 28 for directing exhaust gases from the chamber 26 generally radially inwardly to the turbine wheel 22. The exhaust gases are expanded as they pass through the turbine wheel, and rotatably drive the turbine wheel, which in turn rotatably drives the compressor wheel 14 as already noted.

With reference to FIG. 1, in the illustrated embodiment, the compressor housing 16 is formed by two separately formed housing portions 16-1 and 16-2. The first housing portion 16-1 comprises a cover that is received into a cylindrical receptacle defined by the second housing portion 16-2. The first housing portion is secured by fasteners 15 to the second housing portion. The first housing portion defines the air inlet 17, which includes a generally cylindrical inner surface 17*i* that has a diameter generally matched to the diameter of an inducer portion 14*i* of the compressor wheel.

The second housing portion 16-2 defines a shroud surface 16*s* that is closely adjacent to the radially outer tips of the compressor blades. The shroud surface defines a curved contour that is generally parallel to the contour of the compressor wheel.

The compressor housing 16 upstream of the compressor wheel 14 defines an annular space S located radially outward of the air inlet 17. An axial extent of the annular space is bounded between a radially extending upstream wall UW which is part of the first housing portion 16-1 and a radially extending downstream wall DW which is part of the second housing portion 16-2. A radially innermost extremity of the annular space is open to the air inlet 17.

The compressor of the turbocharger includes an inlet-adjustment mechanism 100 disposed in the annular space S of the compressor housing. The inlet-adjustment mechanism is operable for adjusting an effective diameter of the air inlet into the compressor wheel. As such, the inlet-adjustment mechanism is movable between an open position and a closed position, and various points intermediate said positions.

Figure 2:
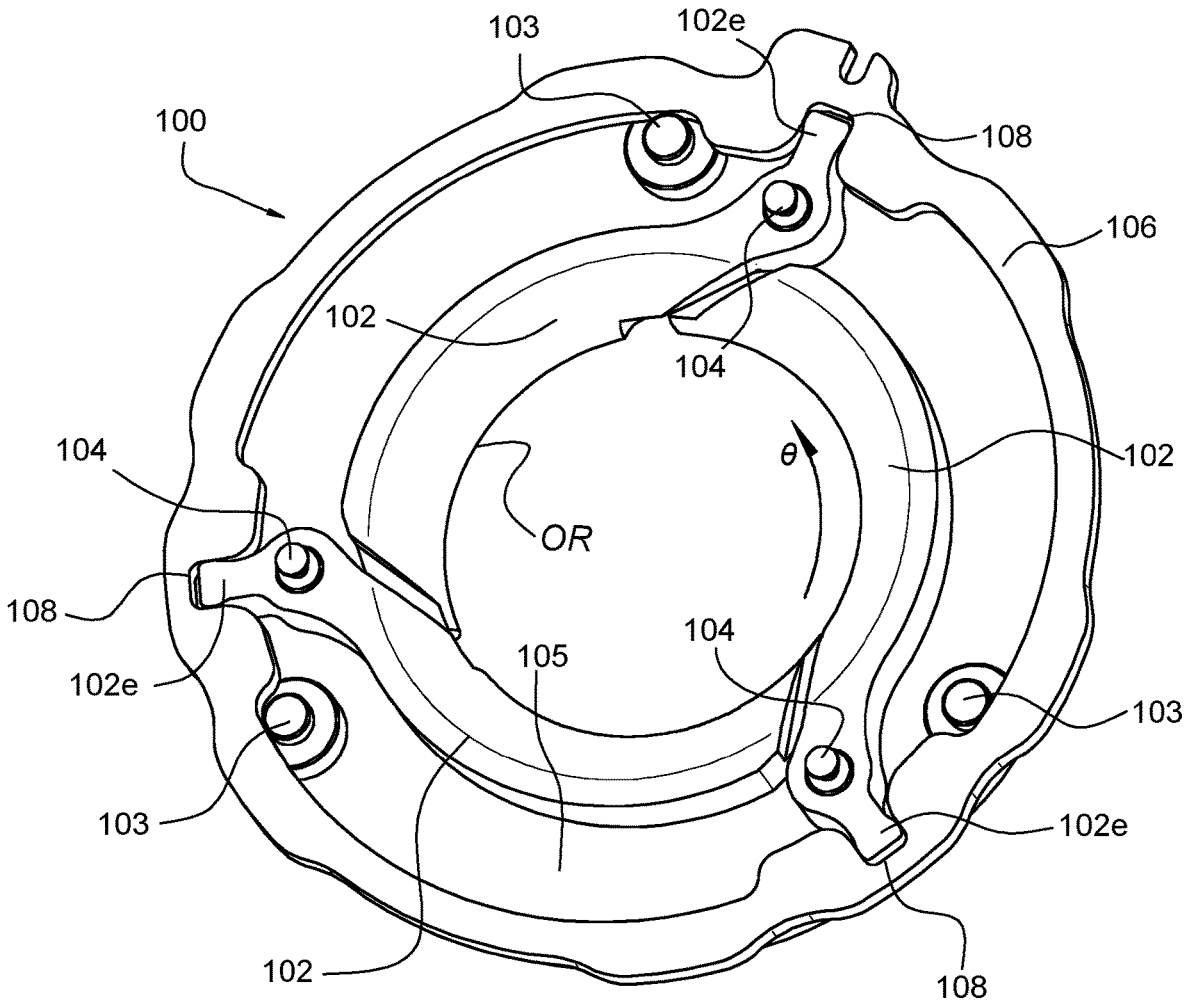
FIG. 2 is an isometric view of an exemplary inlet-adjustment mechanism usable in the practice of the invention.
Figure 3A:
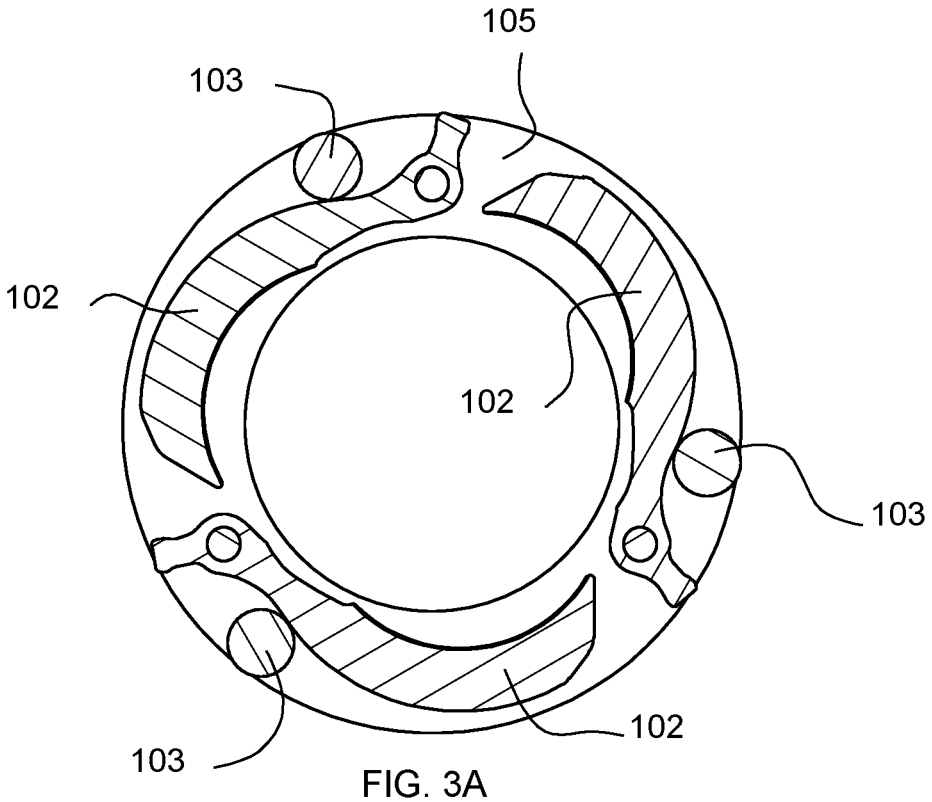
FIG. 3A is a cross-sectional view through the inlet-adjustment mechanism of FIG. 2, on a plane normal to the turbocharger axis, showing the mechanism in an open position.
Figure 3B:
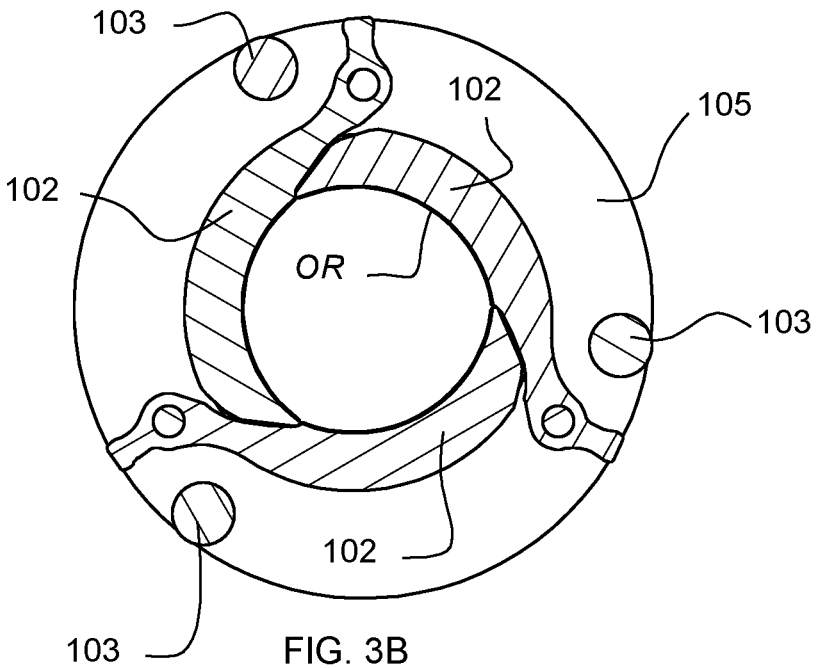
FIG. 3B is similar to FIG. 3A but shows the mechanism in a closed position.

With reference now to FIGS. 2, 3A, and 3B, in the illustrated embodiment the inlet-adjustment mechanism comprises a plurality of blades 102 arranged about the central axis of the air inlet and each pivotable about a pivot pin 104 located at or near one end of the blade. The inlet-adjustment mechanism can include an annular end plate 105 and the pivot pins can be secured in the annular end plate 105 with the blades arranged to rest against the end plate. Alternatively, the pivot pins can be secured in the downstream wall DW of the compressor housing 16 and the blades can rest against the downstream wall. A plurality of guides 103 are also secured in the end plate or downstream wall and are located so as to engage the circular inner periphery of a unison ring 106 that is substantially coplanar with the blades 102. The guides 103 serve to guide the unison ring when it is rotated about its central axis (which coincides with the rotational axis of the turbocharger), so that the unison ring remains substantially concentric with respect to the end plate 105. The guides 103 can comprise rollers or fixed guide pins. The inner periphery of the unison ring defines a plurality of slots 108, equal in number to the number of blades 102. Each blade includes an end portion 102*e* that engages one of the slots 108, so that when the unison ring is rotated about its axis, the blades are pivoted about the pivot pins 104.

As shown in FIG. 1, as noted, the inlet-adjustment mechanism 100 is disposed in the annular space S of the compressor housing. The range of pivotal movement of the blades 102 is sufficient that the blades can be pivoted radially outwardly (by rotation of the unison ring in one direction, clockwise in FIG. 2) to an open position as shown in FIG. 3A, in which the blades are entirely radially outward of the inner surface 17*i* of the inlet. As such, in the open position of the blades, the inlet-adjustment mechanism does not alter the nominal inlet diameter as defined by the inlet surface 17*i*. The blades can also be pivoted radially inwardly (by rotation of the unison ring in the opposite direction, counterclockwise in FIG. 2) to a closed position as shown in FIG. 3B. In the closed position, the circular-arc edges along the radially inner sides of the blades collectively form an orifice OR having a diameter that is less than that of the inlet surface 17*i*. This has the consequence that the effective diameter of the inlet is reduced relative to the nominal inlet diameter. Furthermore, the blades can be pivoted to any of various intermediate positions between the open and closed positions as desired. In this manner, the inlet-adjustment mechanism is able to regulate the effective diameter of the air inlet approaching the compressor wheel.

The invention is not limited to inlet-adjustment mechanisms having arcuate pivotable blades as shown. Various other types of inlet-adjustment mechanisms can be used in the practice of the present invention, including but not limited to the mechanisms described in the commonly owned Applications as previously noted and incorporated herein by reference.

At low flow rates (e.g., low engine speeds), the inlet-adjustment mechanism 100 can be placed in the closed position of FIG. 3B. This can have the effect of reducing the effective inlet diameter and thus of increasing the flow velocity into the compressor wheel. The result will be a reduction in compressor blade incidence angles, effectively stabilizing the flow (i.e., making blade stall and compressor surge less likely). In other words, the surge line of the compressor will be moved to lower flow rates (to the left on a map of compressor pressure ratio versus flow rate).

At intermediate and high flow rates, the inlet-adjustment mechanism 100 can be partially opened as in FIG. 3A. This can have the effect of increasing the effective inlet diameter so that the compressor regains its high-flow performance and choke flow essentially as if the inlet-adjustment mechanism were not present and as if the compressor had a conventional inlet matched to the wheel diameter at the inducer portion of the wheel.

Figure 1A:
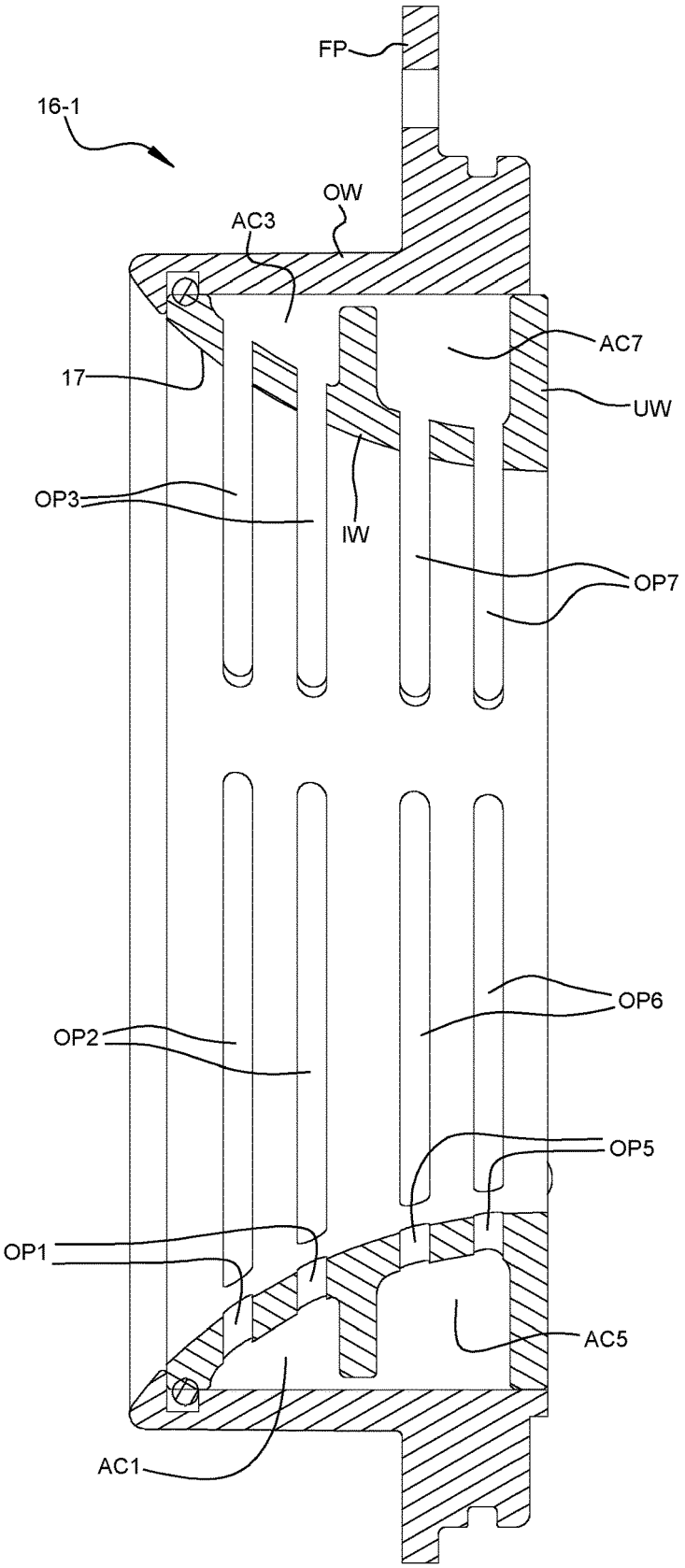
FIG. 1A is an axial cross-sectional view of a first housing portion of the compressor housing for the turbocharger of FIG. 1.
Figure 4:
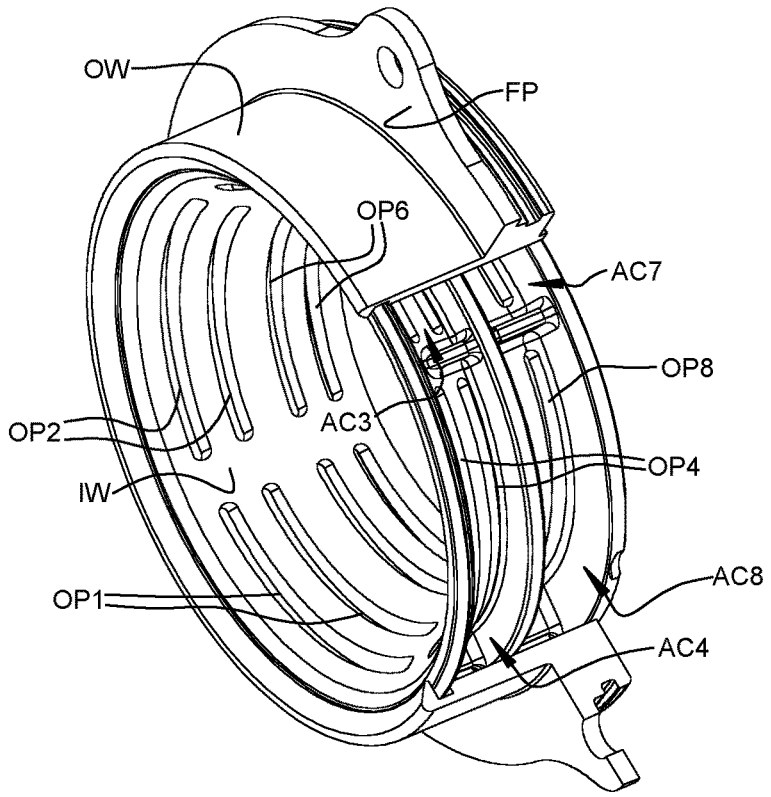
FIG. 4 is an isometric view of a first housing portion of the compressor housing for the turbocharger of the first embodiment, with a part of the first housing portion broken away to show internal details.
Figure 5:
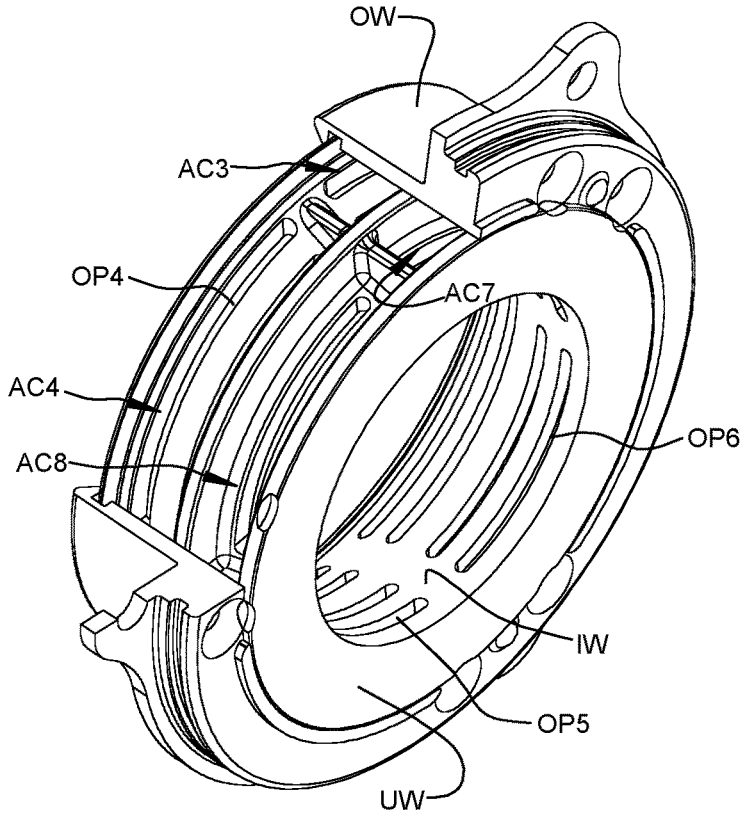
FIG. 5 is another isometric view of the first housing portion of FIG. 4.

As previously noted, Applicant has discovered that when the inlet-adjustment mechanism is in the closed position to reduce the effective inlet diameter, noise and flow pulsation or fluctuation in the inlet can occur. The present invention is aimed at mitigating such noise and flow pulsation, through the provision of a series of acoustic cavities within the compressor housing upstream of the inlet-adjustment mechanism. With reference to FIGS. 1A, 4, and 5, a first embodiment of the invention is depicted. In the first embodiment, the first housing portion 16-1 includes a tapering or funnel-shaped part that defines an air inlet wall IW as well as the upstream wall UW, and further includes an outer wall OW that is generally cylindrical but also has a radially outwardly extending flange portion FP that receives the fasteners 15 (FIG. 1) for securing the first housing portion to the second housing portion of the compressor housing. In the illustrated embodiment (best seen in FIG. 1A), the funnel-shaped part is formed separately from the outer wall, and they are assembled together to form the first housing portion. The inlet wall 1W defines the inlet 17 for the compressor. In this embodiment, a series of acoustic cavities AC are defined within the first housing portion, between the inlet wall 1W and the outer wall OW, and there are openings OP through the inlet wall leading into the acoustic cavities. In the particular embodiment shown in the figures, there are eight acoustic cavities, denoted AC1 through AC8, and for each cavity there are two openings (denoted OP1 through OP8, respectively) through the inlet wall into the respective cavity. Each of the openings OP1 through OP8 is circumferentially elongated in the illustrated embodiment. The acoustic cavities AC1 through AC4 are circumferentially spaced about the circumference of the first housing portion and each is elongated in the circumferential direction, and similarly the acoustic cavities AC5 through AC8 are circumferentially spaced about the circumference and are axially spaced downstream of the cavities AC1 through AC4. The two openings OP1 for the first acoustic cavity AC1 are axially spaced apart from each other, and similarly each additional acoustic cavity has two axially spaced openings.

Each acoustic cavity with its associated openings acts as a Helmholtz resonator. The various Helmholtz resonators can each be tuned to a particular frequency so that noise of that frequency is attenuated by the resonator. As those skilled in the art will recognize, the frequency to which a Helmholtz resonator is tuned is primarily a function of the volume of the acoustic cavity, the length of the neck that leads from the main fluid duct into the cavity, and the cross-sectional area of the neck. In accordance with the invention, the number of acoustic cavities and their dimensional parameters can be selected to attenuate the noise frequency components that are of most concern. Thus, while the illustrated embodiment has eight acoustic cavities, the invention is not limited to any particular number of cavities. Similarly, while there are two openings into each cavity in the illustrated embodiment, the invention is not limited to any particular number of openings.

Figure 6:
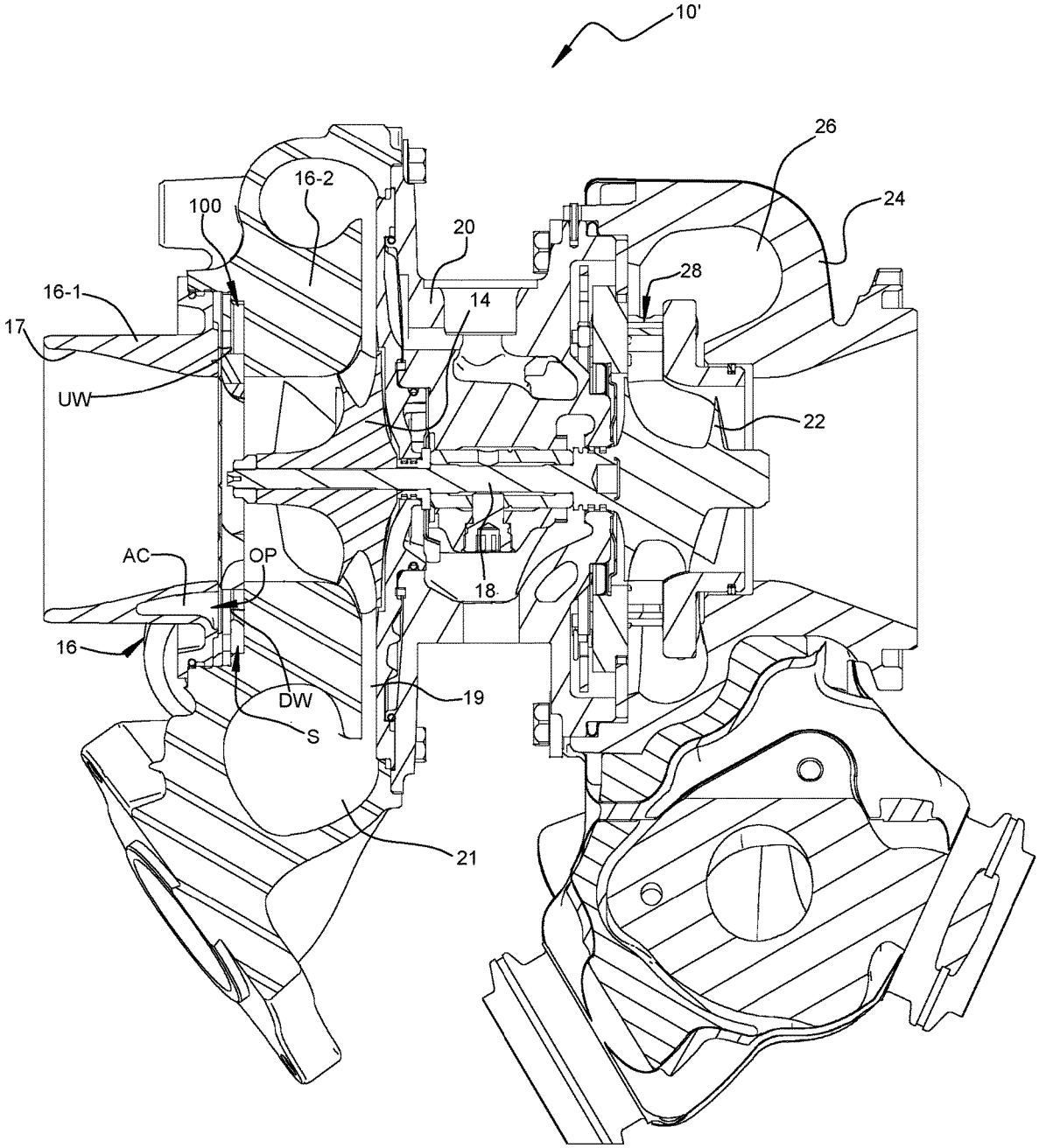
FIG. 6 is an axial cross-sectional view of a turbocharger in accordance with a second embodiment of the invention.
Figure 7:
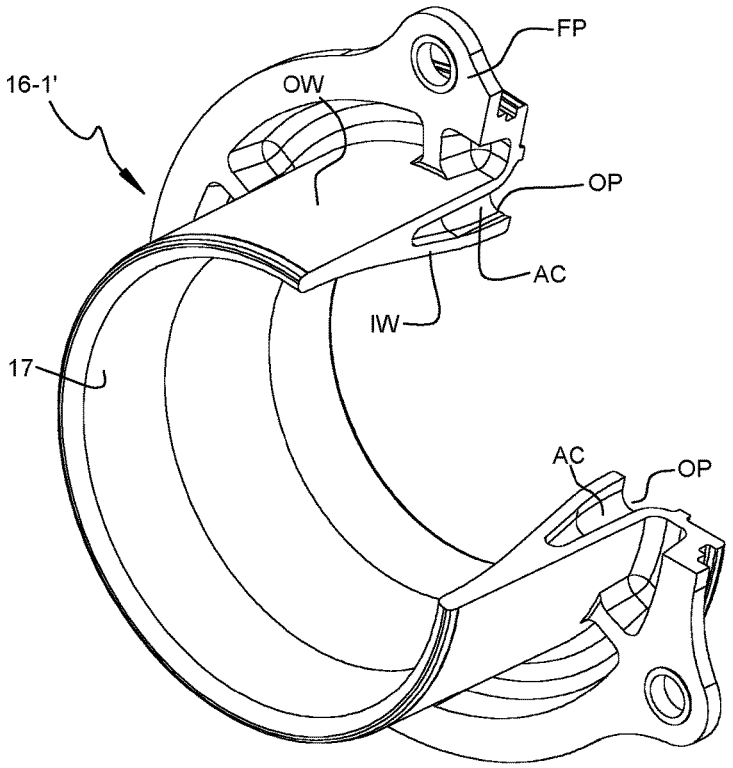
FIG. 7 is an isometric view of a first housing portion of the compressor housing for the turbocharger of the second embodiment, with a part of the first housing portion broken away to show internal details.
Figure 8:
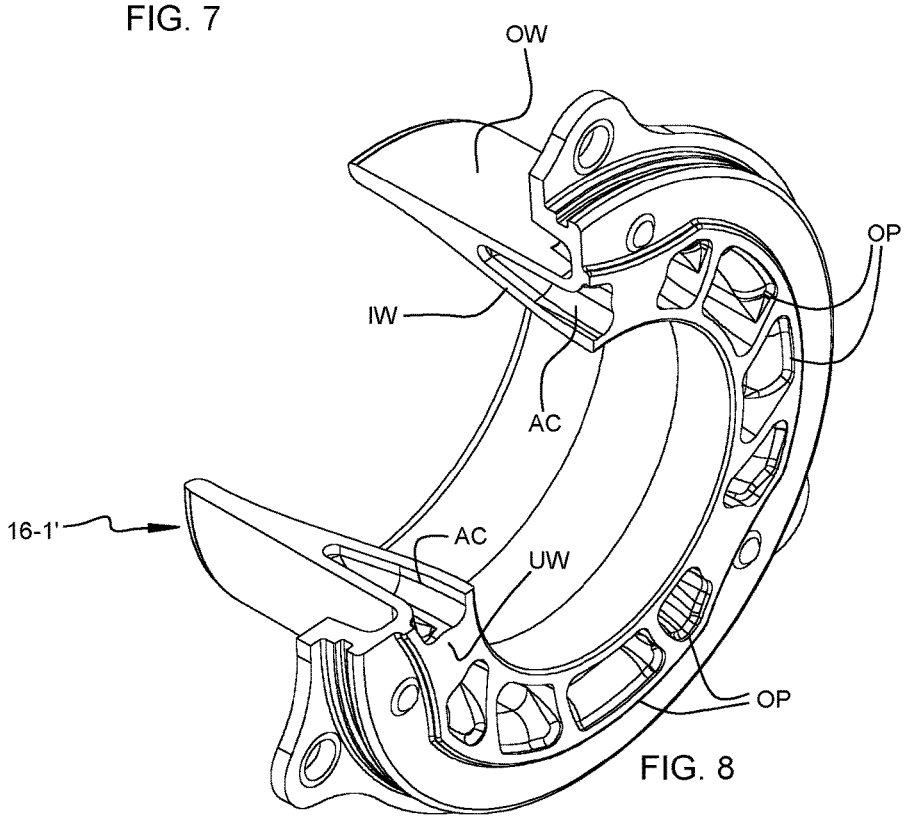
FIG. 8 is another isometric view of the first housing portion of FIG. 7.

A second embodiment of the invention is illustrated in FIGS. 6 through 8. The turbocharger 10' in FIG. 6 differs from that of the first embodiment primarily in the construction of the first housing portion 16-1' defining the noise-attenuating features. Thus, the first housing portion 16-1' includes an outer wall OW and an inlet wall IW generally as in the previous embodiment, but in the second embodiment the inlet wall does not define any openings into acoustic cavities. Rather, the upstream wall UW bounding one side of the annular space S defines openings OP that are circumferentially spaced apart, and each opening OP leads into an acoustic cavity AC that is separate from all of the other acoustic cavities. The acoustic cavities AC are disposed within the first housing portion, between the outer wall and the inlet wall, and they are circumferentially spaced apart about the circumference of the first housing portion. Accordingly, the openings OP into the acoustic cavities AC are open to the annular space S that houses the inlet-adjustment mechanism 100. The open acoustic cavities act as quarter-wave resonators. Those skilled in the art will recognize that the frequency attenuated by a quarter-wave resonator is determined by the length of the cavity, the length in the present context being the dimension of the acoustic cavity AC in the axial direction of the turbocharger. Accordingly, the various acoustic cavities can have different lengths for respectively attenuating different noise frequency components.

Many modifications and other embodiments of the inventions set forth herein will come to mind to one skilled in the art to which these inventions pertain having the benefit of the teachings presented in the foregoing descriptions and the associated drawings. For example, it is within the scope of the invention to combine Helmholtz resonators according to the first embodiment with quarter-wave resonators according to the second embodiment within the same turbocharger compressor. Additionally, as noted, the number, sizes, and arrangement of the acoustic cavities and their associated openings can be different from those shown in the drawings, the invention not being limited in such respects. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A turbocharger, comprising:

a turbine including a turbine housing;

a compressor assembly comprising a compressor housing and a compressor wheel mounted in the compressor housing and connected to a rotatable shaft for rotation therewith, the compressor wheel having blades and defining an inducer portion, the compressor housing comprising a first housing portion and a second housing portion, the first housing portion comprising an outer wall and an inlet wall formed as a unitary member, the outer wall being disposed radially outwardly of the inlet wall, the inlet wall circumscribing an air inlet for the compressor wheel, the second housing portion defining a tip shroud for the compressor wheel and defining a volute for receiving compressed air from the compressor wheel, the compressor housing upstream of the compressor wheel defining an annular space located radially outward of the air inlet, an axial extent of the annular space being bounded between a radially extending upstream wall which is part of the first housing portion and a radially extending downstream wall which is part of the second housing portion, a radially innermost extremity of the annular space being open to the air inlet;

an inlet-adjustment mechanism disposed in the annular space and adjustable between an open position and a closed position, the inlet-adjustment mechanism being movable radially inwardly from the annular space into the air inlet into the closed position so as to create an orifice having a reduced diameter relative to a nominal diameter of the air inlet; and wherein the first housing portion defines a first quarter-wave resonator cavity wholly disposed between the outer wall and the inlet wall of the first housing portion, the first housing portion further defining a first opening in the radially extending upstream wall, the first opening leading into the first quarter-wave resonator cavity.

2. The turbocharger of claim 1, wherein the radially extending upstream wall defines a second opening circumferentially spaced from the first opening, and wherein the first housing portion defines a second quarter-wave resonator cavity wholly disposed between the outer wall and the inlet wall and circumferentially spaced from the first quarter-wave resonator cavity, the second opening leading into the second quarter-wave resonator cavity.

3. The turbocharger of claim 2, wherein the radially extending upstream wall defines a third opening and a fourth opening, wherein the first housing portion defines a third quarter-wave resonator cavity and a fourth quarter-wave resonator cavity each wholly disposed between the outer wall and the inlet wall, the third opening and the fourth opening respectively leading into the third quarter-wave resonator cavity and the fourth quarter-wave resonator cavity, and wherein the first opening, the second opening, the third opening, and the fourth opening are circumferentially spaced apart, and the first quarter-wave resonator cavity, the second quarter-wave resonator cavity, the third quarter-wave resonator cavity, and the fourth quarter-wave resonator cavity are circumferentially spaced apart.

* * * * *